US005177926A

United States Patent [19]

Frankel

[11] Patent Number: 5,177,926

[45] Date of Patent: * Jan. 12, 1993

[54] MODULAR ARCHITECTURAL STRUCTURE FOR PLAYGROUND AND THE LIKE

[75] Inventor: Arie Frankel, Melville, N.Y.

[73] Assignee: American Playtime Systems, Inc., Melville, N.Y.

[ * ] Notice: The portion of the term of this patent subsequent to Aug. 11, 2009 has been disclaimed.

[21] Appl. No.: 688,994

[22] Filed: Apr. 25, 1991

Related U.S. Application Data

[63] Continuation-in-part of Ser. No. 521,139, May 8, 1990, Pat. No. 5,137,271.

[51] Int. Cl.[5] ..... E04H 12/00

[52] U.S. Cl. ..... 52/655.1; 482/35; 472/116; 472/136; 472/137

[58] Field of Search ..... 472/116, 118, 135-137; 482/35; 52/648, DIG. 10

[56] References Cited

U.S. PATENT DOCUMENTS

| | | | |
|---|---|---|---|
| 2,956,806 | 10/1990 | Routson | 482/35 |
| 3,632,109 | 1/1972 | Dattner | 472/116 |
| 3,949,985 | 4/1972 | Stampli | 482/35 |
| 4,301,766 | 11/1981 | Piccone | 482/35 |
| 4,369,965 | 1/1983 | Ahrens | 472/116 |

FOREIGN PATENT DOCUMENTS 1391218 4/1975 United Kingdom .

*Primary Examiner*—Richard E. Chilcot, Jr.
*Attorney, Agent, or Firm*—Kane, Dalsimer, Sullivan, Kurucz, Levy, Eisele and Richard

[57] ABSTRACT

An architectural structure is made of one or more walls, each wall consisting of a lattice of rigid cells hingedly interconnected and supported by frame members. The cells may have holes sized and constructed to make the walls suitable for playground equipment.

20 Claims, 6 Drawing Sheets

MODULAR ARCHITECTURAL STRUCTURE FOR PLAYGROUND AND THE LIKE

RELATED APPLICATIONS

This is a continuation-in-part to application Ser. No. 521,139, filed May 8, 1990, now U.S. Pat. No. 5,137,271.

BACKGROUND OF THE INVENTION

1. Field of Invention

This invention pertains to a novel modular structure for use on playgrounds, and other wall-type structures such as fencing and so on, and more particularly to a structure consisting of several relatively flat cells having a preselected geometric shape which are hingedly interconnected.

2. Brief Description of the Prior Art

Typically, playgrounds or other areas dedicated for children's activities include structures adapted for climbing. These structures are made either of metal bars, such as the well known monkey bars, or are cement structures. However, these structures are usually unsafe and thousands of serious injuries occur every year.

Other structures have been proposed to replace the ones presently in use but with relatively little success. For example, a net-like structure composed of circular plastic rings interconnected by straps is shown on page 14 of the Jun. 4, 1988 edition of the Israeli magazine Maariv. However, this structure is unsafe because it has holes of sizes and shapes which may entrap a child's head, hand, or foot. Other proposed architectural structures are shown in U.S. Pat. No. Des. 218,455; U.S. Pat. Nos. 3,974,611; 2,956,806; 4,603,853; and 3,970,301. However, none these structures are acceptable because they are unsafe. Furthermore, the structures shown in the above-mentioned references are two complicated and expensive to make, and are often unsuitable for outdoor installations.

SUMMARY OF THE INVENTION

In view of the above-mentioned disadvantages of the prior art it is an objective of the present invention to provide a structure which can be safely installed and used thereby avoiding crippling, and fatal injuries.

A further objective is to provide a modular structure which can be used in virtually an infinite number of configurations.

Yet another objective is to provide a structure which can be formed into aesthetically pleasing and colorful configurations so they are attractive to children.

Yet a further objective is to provide a modular structure which is made of materials which are safe for use by children, yet strong enough to withstand the natural elements whereby the structures can be installed outdoors.

Another objective is to provide a modular structure which is made of relatively inexpensive materials, and which can be easily assembled into various configuration on site.

Other objectives and advantages of the invention will become apparent form the following description for the invention. An architectural structure constructed in accordance with this invention includes one or more walls, each wall consisting of a rigid frame, a plurality of flat rigid cells, and flexible hinge means for interconnecting said cells or connecting said cells to the frame so that there is no substantial space left therebetween, to avoid entrapping a child's head or limbs. The cells are preferably made of a high density plastic material capable of withstanding natural forces including wide temperature swings, wind, humidity, snow or rain without degradation. The hinges ar preferably made of a nylon or other flexible material and are imbedded in the cells to reduce exposure to the elements or to vandalism.

In an alternate embodiment, the cells are made with matching male and female interconnecting members fitting into each other. The interconnecting members are perforated to allow adjacent cells to be coupled by hinging pins.

DETAILED DESCRIPTION OF THE INVENTION

Figure 1:
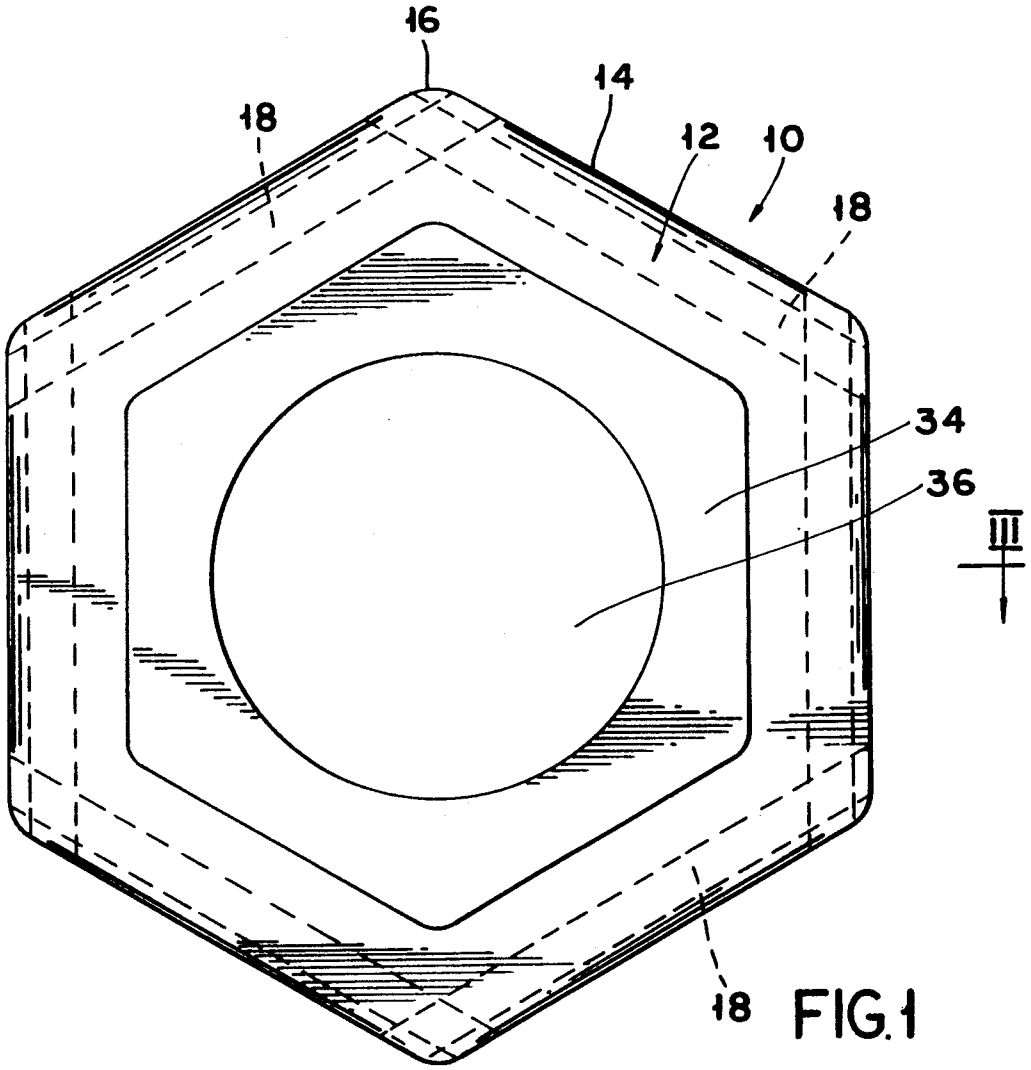
FIG. 1 shows a plan view of a basic cell used in a structure constructed in accordance with this invention.
Figure 2:
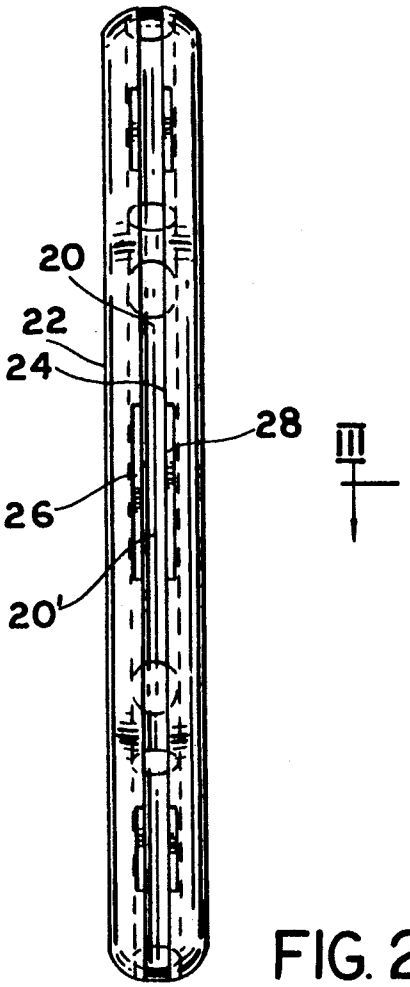
FIG. 2 shows a side view of the cell of FIG. 1.
Figure 3:
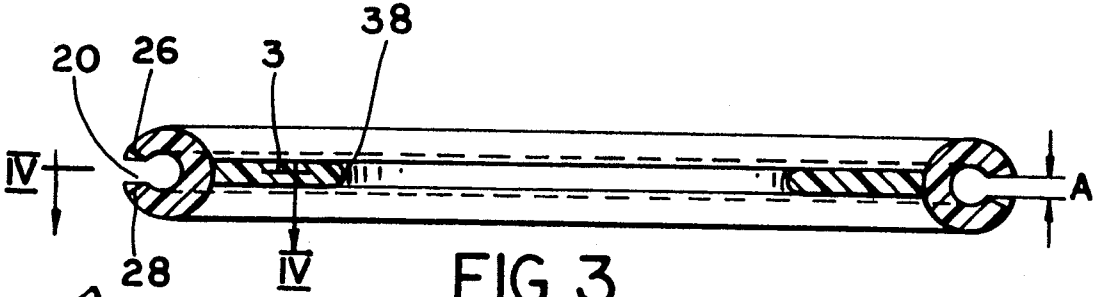
FIG. 3 shows a sectional view of the cell of FIG. 1 taken along lines 3—3 in FIG. 1.
Figure 4:
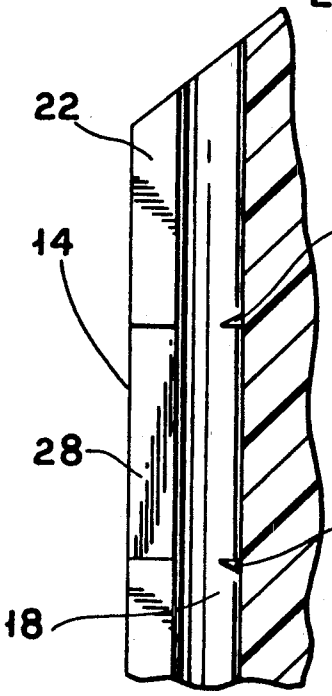
FIG. 4 shows a partial sectional view of the cell taken along line 4—4 in FIG. 3.

Referring now to the Figures, and more particularly to FIGS. 1–4, a modularity of the inventive structure described herein is provided by a basic cell which may be interconnected with other cells to produce a wall member of any desired shape and dimension for a modular structure. A typical basic cell 10 as shown in the Figures is generally flat (i.e. its overall length and width are much greater then its depth). The cell 10 may have any geometric shape, but preferably a shape should be selected which would permit several cells to be interconnected to form a large wall with substantially no holes therebetween which may entrap a child's head or limbs. In FIG. 1 cell 10 is shown to be generally hexagonal because this configuration can be used to construct a large number of different structures, however, the cell may also be square, rectangular, triangular, pentagonal, and so on. Preferably, all the edges of the cell are rounded to eliminate the risk of cuts and scratches. The cell 10 consists of a peripheral hexagonal member 12 with a substantially circular cross section as shown. Member 12 is defined by six straight edges 14. (Of course the number of edges 14 for each cell 10 depends on its geometric shape). Preferably, where two edges 14 meet, the cell 10 is rounded, as at corner 16. Member 12 is formed with circular throughholes 18, each throughhole 18 being disposed substantially in parallel with a corresponding edge 14 at a distance W as shown in FIG. 4. Each throughhole 18 is open toward an edge 14 by a channel 20. Adjacent to corner 16, each channel 20 is defined by two parallel walls 22, 24 formed in member 12 and separated by a distance A so that the channel has a uniform cross-sectional radial dimension therebetween. However, the channel also has a central section 20' defined by two walls 26, 28 extending somewhat at angular, or radially with respect to the axis of throughhole 18. At the edges bordering on hole 18, the tangential or peripheral distance between walls 26, 28 is substantially equal to dimension A defined above. In the region defined by walls 26, 28, channel section 20' has a cross sectional dimension which increases radially outward as shown in FIG. 3. At the two longitudinal ends of walls 26, 28, throughholes 18 are formed with two ramps 30, 32 as shown in FIG. 4.

Cell 10 further includes a web 34 extending inwardly from member 12. Web 34 may be continuous, or it may be formed with a substantially circular hole 36. The inner edge 38 defining hole 36 is preferably rounded as shown in FIG. 3.

Figure 5:
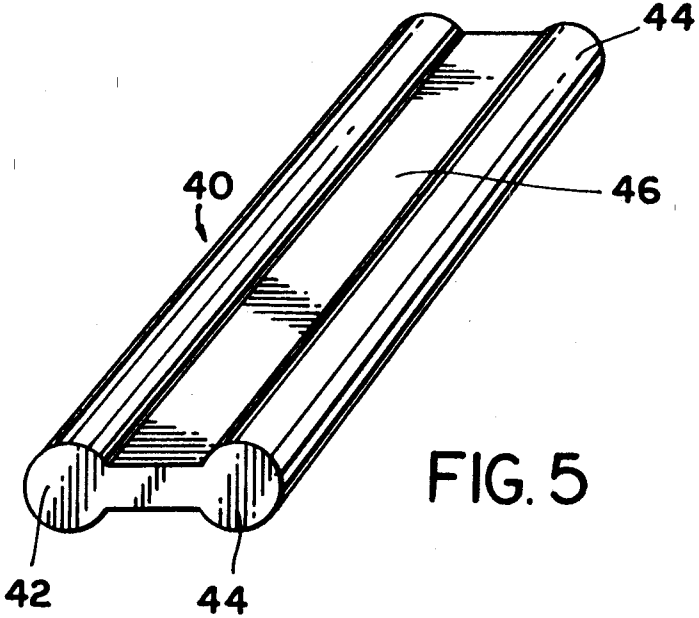
FIG. 5 shows an isometric view of a hinge used to interconnect cells in accordance with this invention.

The inventive structure also includes a plurality of hinges such as hinge 40 shown in FIG. 5. This hinge 40 consists of two cylindrical portions 42, 44 arranged substantially in parallel. The portions 42, 44 have a smaller diameter then the diameter of throughholes 18 in cell 10, and a length which is equal to or slightly smaller than the longitudinal distance between ramps 30, 32 shown in FIG. 4. Portions 42, 44 are connected by a coextensive hinging section 46 which is relatively flat, and which has a thickness slightly smaller than dimension A. Laterally, the distance between portions 42, 44 exceeds twice dimension W.

Figure 6:
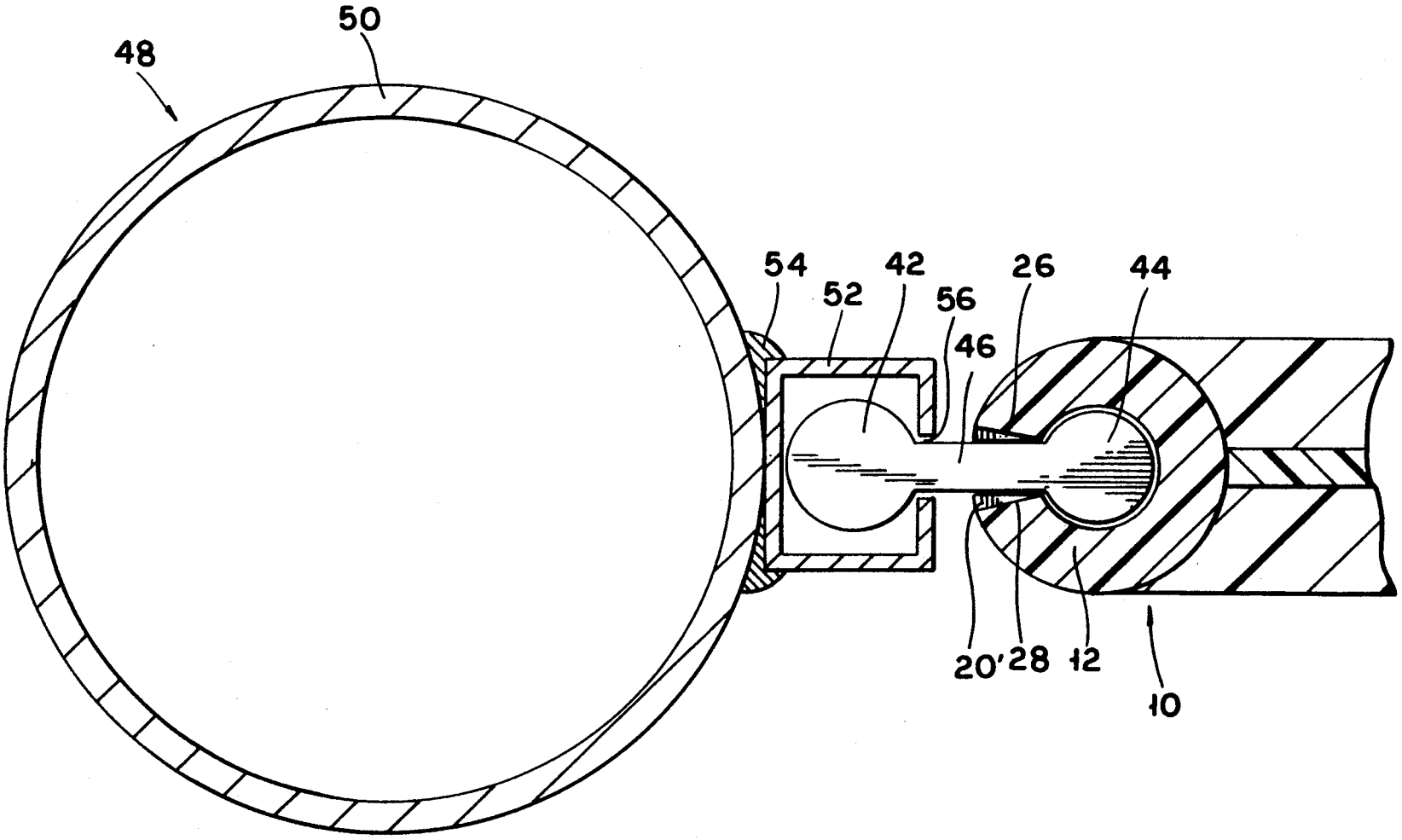
FIG. 6 is a cross-sectional view of a cell connected to a frame member.

Hinge 46 may be used to couple a cell 10 to another cell or to a stationary frame. For example, FIG. 6 shows a stationary frame member 48 consisting of an elongated hollow tube 50 with a channel shaped member 52. Member 52 is secured to tube 50 by a weld 54, by an adhesive, or any other well-known means. Member 52 has a lateral opening 56. A cell 10 is secured to member 48 as follows. First one portion 42 is inserted into channel member 52 with the hinge web 46 extending through opening 56. A cell 10 is then mounted on hinge 40 by throughhole 18 until it passes one of the ramps, such as ramp 30 passes the hinge 40. The ramps 30, 32 and the inner wall of throughhole 18 are sized and arranged to capture a hinge 40 whereby once the a hinge is inserted therebetween an interference fit is formed between the ramps and the hinge thereby making it difficult to separate the hinge 40 from cell 10. Of course, a cell 10 may be secured to identical cell 10 in a similar manner Importantly, because walls 26, 28 are disposed at an angle, they allow relative angular movement between a cell and frame member 48, or another cell 10. Furthermore, hinge 40 may be made of a relatively flexible and a somewhat extendible or elastic material to permit adjacent cells 10 interconnected by hinges 40 to flex, as well as, to pivot slightly relative to each other.

Figure 7:
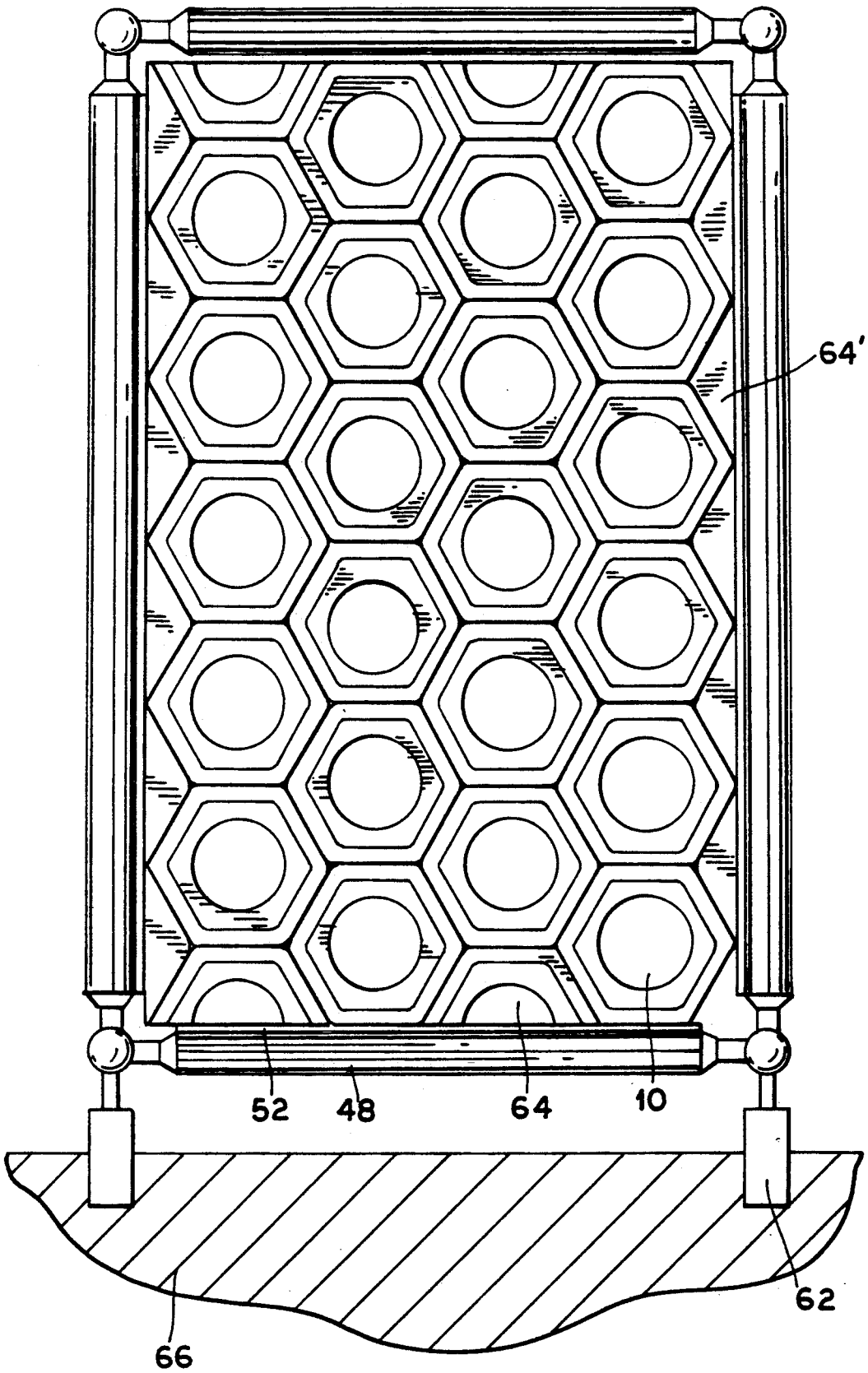
FIG. 7 shows an elevational view of a modular structure constructed in accordance with this invention.
Figure 8:
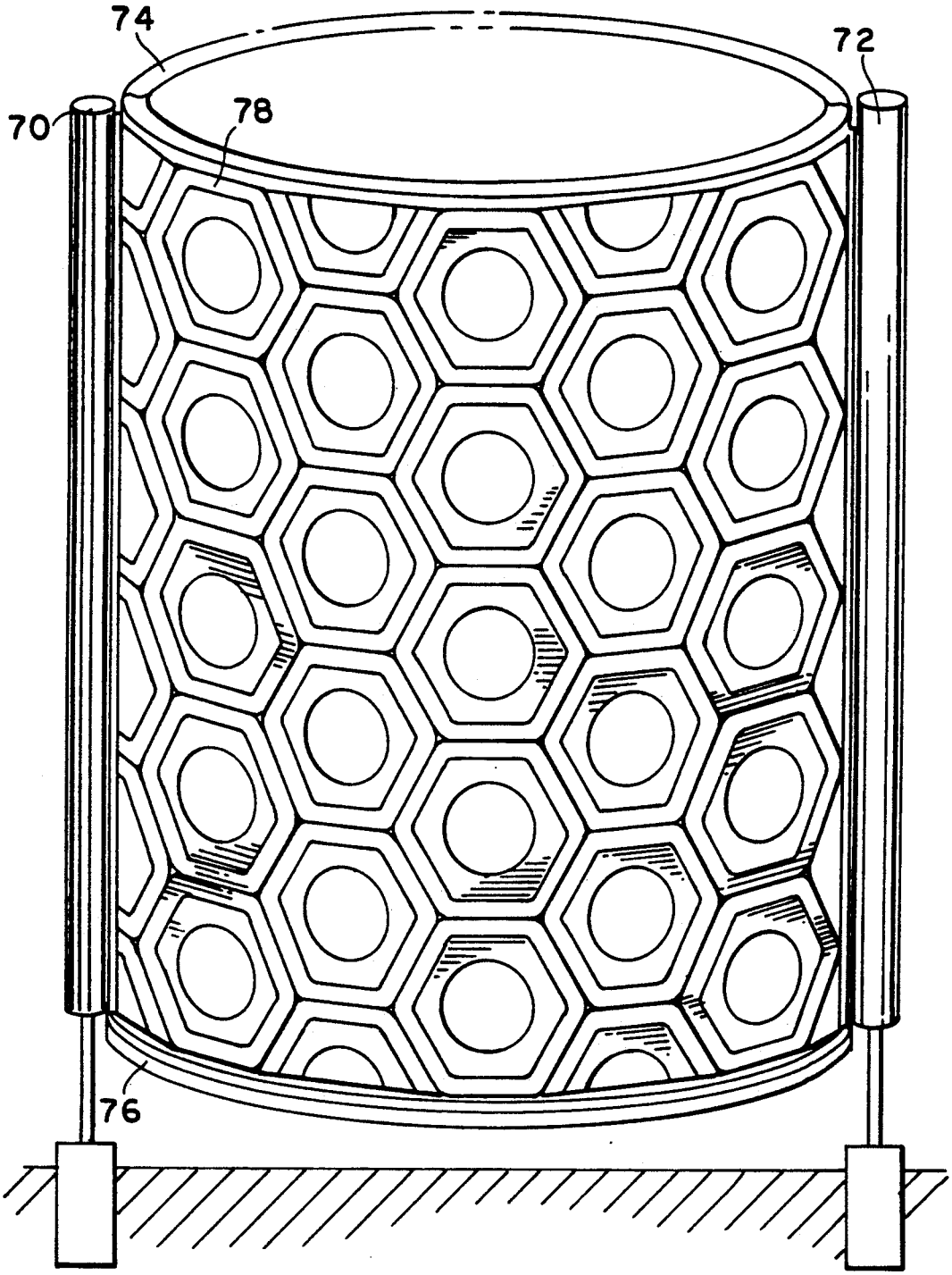
FIG. 8 shows an elevated view of a cylindrical structure constructed in accordance with this invention.

FIG. 7 shows how a modular wall 60 may be made of a plurality of cells 10 interconnected by hinges 40 and supported by a plurality of frame members 48. The frame members may be interconnected at the corners by corner balls 60. Furthermore, some of the lower corner balls may be mounted on stationary support such as a post 62 fully or partially buried in the ground 66. Preferably, at the interface between a frame member 48 and basic cells 10, a second half-hexagonal cell 64 or a triangular cell 64' may be used as shown in FIG. 7 to eliminate holes which may trap a child's limb or head. Cells 64, 64' are formed with channel means for engaging hinges as described above. Several planar walls such as the wall shown in FIG. 7 may be interconnected to make any shape desired. Furthermore, curved walls may also be formed to form cylindrical shapes as shown in FIG. 8 or any other shapes as desired.

It will be apparent to one skilled in the art that the modular structure described above can be used to make architectural objects of virtually infinite configurations. Objects used in playgrounds may be created by several walls formed as shown in FIG. 7, with the holes 36 being used by children as foot and hand supports. The flexibility provided by the hinges gives each wall or structure a semi-flexible feel similar to a rope net. Other architectural structures such as fences, gazebos, and so on may be made in a similar manner. For these structures, holes 36 need not be circular or may be omitted completely. The cells 10, frame members 48, and hinges 40 may be shipped separately and assembled at the site.

Preferably each basic cell 10 (and cell 64) is made of high impact, high density polypropylene material which resists wear and tear, and is not corroded or otherwise degraded even when exposed to wind, rain, snow, sun, salty air and so on. Each cell may be made for example by molding. If necessary, two substantially identical sections may be molded separately and joined by sonic welding to form a single, unitary cell 10. Preferably, hinge 40 is made of an elastic material such as nylon. The nylon may be reinforced by fiberglass strands especially in the area of the web to resist tearing. It should be noted that since most of the nylon hinges are disposed inside throughholes 18, they will be protected from the elements or vandalism by the cells 10 or channels 52. The cells can have any shape or size. For example, a hexagonal cell may have an overall length and width in the range of 5/16" and a thickness in the range of from ½" to 1½".

Frame members 48 with channel members 52 may be made of metallic material such an aluminum or aluminum alloy made, for example, by extrusion. For installations exposed to extreme weather conditions, such as the sea shore, the frame members are preferably galvanized or otherwise coated with a protective layer.

FIG. 8 shows a cylindrical structure constructed in accordance with this invention including two uprights 70, 72 and hoops 74, 76 supporting a plurality of interconnected cells 78.

Figure 10:
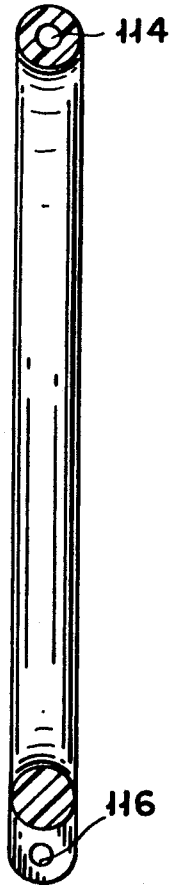
FIG. 10 shows a side-sectional view of the cell of FIG. 9 taken along line 10—10.
Figure 9:
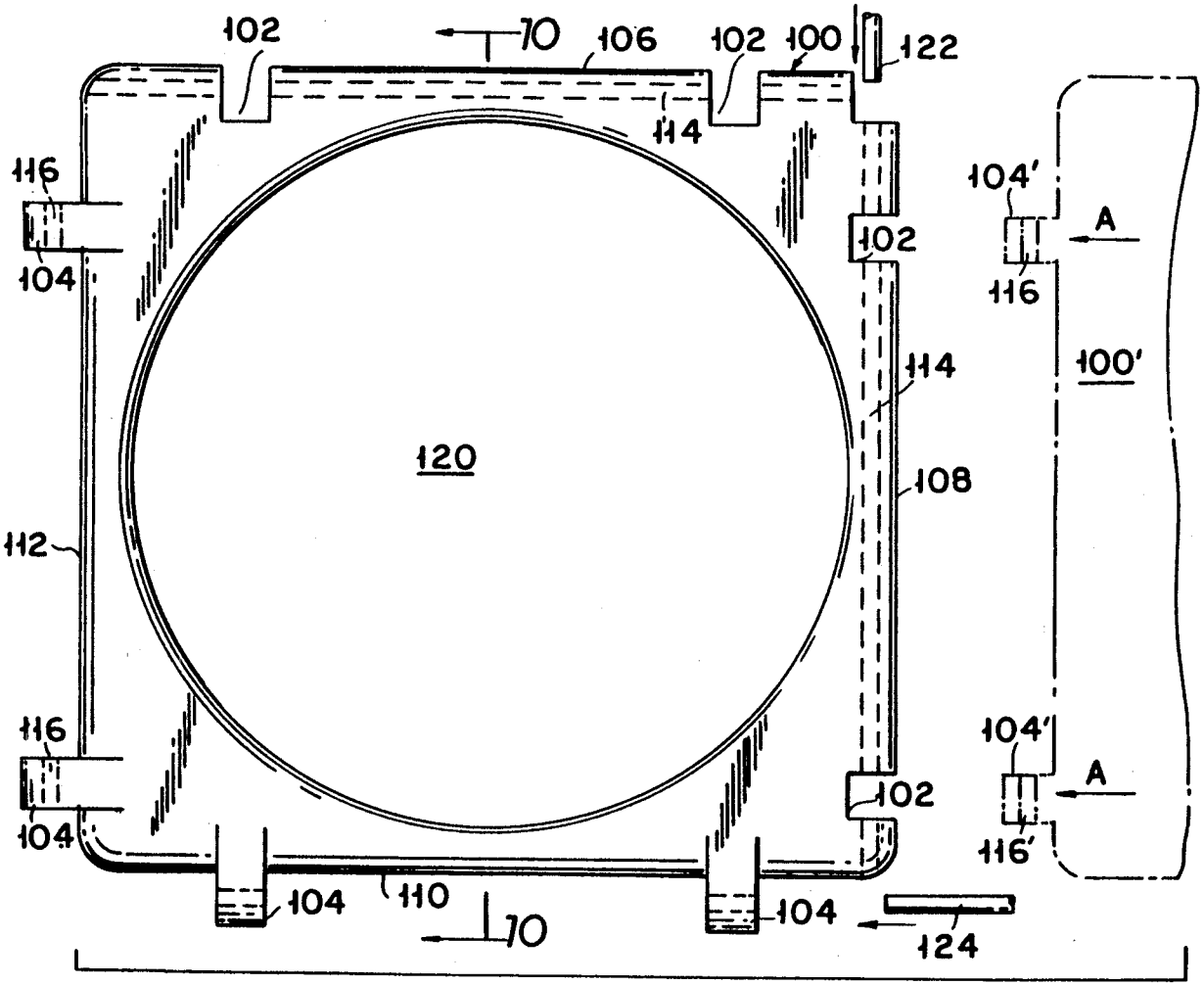
FIG. 9 shows a plan view of an alternate embodiment for the cell.

In a somewhat preferred embodiment of the invention, shown in FIGS. 9 and 10, the cells 100 are made with one or more notches 102 on sides 106 and 108. Sides 110 and 112 are provided with tongues 104 shaped to fit into notches 102. In addition, sides 106 and 108 are provided with through holes 114 which open into notches 102. Tongues are also provided with through holes 116. Cell 100 is formed with a central round opening 120 as in the other embodiment. The sides of the cell 100 are rounded as shown in FIG. 10 to prevent cuts and bruises. While cell 100 in the Figures is square, other geometric shapes may also be provided for the cell.

The notches 102, tongues 104 and holes 114, 116 are shaped and arranged so that one cell 100 can be fit together with a similar cell 100' shown in FIG. 9 in phantom lines so that tongues 104' fit into notches 102 as cell 100' is advanced toward cell 100 in the direction indicated by arrow A. When the tongues 104' are seated in notch 102, along side 108 hole is aligned with holes 116'. The two cells then may be coupled by inserting a rigid pin 122 therethrough. Another pin 124 may be used to couple cell 100 to yet another cell. Pins 122, 124 are preferably stainless steel. Various structures for a playground may be obtained by coupling a plurality of cells in this manner. The notches 102 and tongues 104 may also be used to mount the cells on a stationary frame. Obviously numerous modifications may be made to the invention without departing from its scope as defined in the appended claims.

What is claimed is:

1. A modular architectural structure comprising:

a wall including:

a plurality of flat cells made of a rigid material;

a supporting frame defining a preselected shape for said wall; and flexible coupling means for coupling each cell to an adjacent cell and to said supporting frame, said cells being constructed and arranged to leave substantially no space between adjacent cells in said wall.

2. The structure of claim 1 wherein said flexible coupling means comprises male and female intergaging members provided on said cells, and connecting means for connecting at least one male members of one cells to at least one female member of an adjacent cell.

3. The structure of claim 1 wherein each said cell includes a hinge engaging means for engaging said flexible hinge means.

4. The structure of claim 1 wherein each said cell includes a peripheral member surrounding a hole.

5. An architectural structure comprising:

a. a plurality of rigid flat cells consisting of a peripheral member defined by a plurality of linear outer edges;

b. a plurality of hinge means, each hinge means being disposed between the edges of two adjacent cells; and c. support frame means coupled to some of said cells for support.

6. The structure of claim 5 wherein said hinge means comprises male and female interconnecting members provided on said cells and coupling means for coupling interconnecting means of adjacent cells.

7. The structure of claim 5 wherein said peripheral member includes hinge coupling means for coupling said cells to said hinges.

8. The structure of claim 5 wherein said peripheral member includes channel means, and said hinge means includes a first portion and a second portion, said first and second portions being captured by the channel means of a corresponding cell.

9. The structure of claim 5 wherein said hinge means is extensible.

10. The structure of claim 5 wherein said support means includes a plurality of rigid tubes, corners for interconnecting said tubes and support hinge engaging means for engaging said hinge means.

11. An architectural structure comprising:

a plurality of interconnected walls; each wall consisting of a rigid frame with frame hinge engaging means;

a plurality of first rigid cells, each first cell having a peripheral frame defined by linear edges and cell hinge engaging means disposed at said linear edges;

a first set of hinges for coupling said first cells, each said first hinges being engaged by the cell hinge engaging means of two adjacent first cells; and a second set of hinges for coupling some of said first cells to said rigid frame, each said second hinge being disposed between a cell hinge engaging means and a frame hinge engaging means.

12. The structure of claim 11 wherein said cell hinge engaging means includes a throughhole disposed in parallel with a corresponding linear edge.

13. The structure of claim 12 wherein said throughhole includes stop means for frictionally engaging said hinges.

14. The structure of claim 11 wherein said frame hinge engaging means comprises a channel disposed on said frame with a longitudinal opening directed toward said first cells.

15. The structure of claim 11 wherein said first and second hinges each includes a first and a second cylindrical portion for capture by said hinge engaging means, and a hinge web extending between said first and second portions.

16. The structure of claim 11 wherein said first cells ar made of a high-density plastic.

17. The structure of claim 11 further comprising a plurality of second cells arranged and hingedly coupled between some of said first cells and said frame, said second cells having a geometric shape different from said first cells.

18. The structure of claim 11 wherein said hinges are made of nylon.

19. The structure of claim 17 wherein said hinges are made of nylon reinforced in one direction by fiberglass.

20. The structure of claim 11 wherein said hinge means includes a notch formed along an edge of cell, a hole made in said cell along said one edge, a tongue formed along another edge of another cell sized and arranged to fit into said notch, and a pin for connecting said one cell and said another cell by passing through said tongue and said hole.

* * * * *